US006095451A

United States Patent [19]

Walker

[11] Patent Number: 6,095,451

[45] Date of Patent: Aug. 1, 2000

[54] WHEEL WINCH

[76] Inventor: Douglas E. Walker, 90 Mackey Rd., McDonough, Ga. 30252

[21] Appl. No.: 09/412,939

[22] Filed: Oct. 5, 1999

[51] Int. Cl.[7] ..... B65H 75/34

[52] U.S. Cl. ..... 242/392; 180/7.5; 242/407.1

[58] Field of Search ..... 242/392, 407.1, 242/399; 180/7.5

[56] References Cited

U.S. PATENT DOCUMENTS

| | | | |
|---|---|---|---|
| 1,469,506 | 10/1923 | Gillam | 242/392 |
| 2,377,881 | 6/1945 | Hans | 242/407.1 |
| 3,252,672 | 5/1966 | Scott | 242/392 |
| 3,784,164 | 1/1974 | Blum | 242/392 |
| 3,917,228 | 11/1975 | Blum | 242/392 |
| 4,767,081 | 8/1988 | Lau | 242/392 |
| 4,778,126 | 10/1988 | Spann, Jr. | 242/392 |
| 5,115,994 | 5/1992 | Hershberger | 242/392 |

*Primary Examiner*—Katherine A. Matecki
*Attorney, Agent, or Firm*—John L. James

[57] ABSTRACT

A wheel for a vehicle is adapted for use as a winch. The wheel has an axis of rotation, an end face and a contoured surface visible when a tire is mounted on the wheel. A plurality of spaced brackets are fastened to the surface of the wheel and lie parallel to the axis of rotation. A plurality of fingers, with each finger slidably movable in an associated bracket of the plurality of brackets, are deployable from a retracted position at which the fingers lie parallel to the axis of rotation and do not protrude beyond the end face of the wheel, and an extended position at which the fingers extend beyond the end face. When extended, the fingers can engage a rope attached to a stationary object, and when the wheel is rotated, the vehicle can be drawn toward the stationary object thereby rescuing the vehicle from tractionless environments.

7 Claims, 2 Drawing Sheets

WHEEL WINCH

FIELD OF THE INVENTION

The present invention relates generally to a winch for aiding stranded vehicle, and more particularly, to a winch mounted on a wheel of the vehicle.

BACKGROUND OF THE INVENTION

Vehicles have a tendency to become stuck or bogged down when operating in mud, snow, sand and other materials. A winch can be used to free the vehicle. With the proliferation off-road and all terrain vehicles it is possible to have such a vehicle equipped with a self-contained winch. These winches are typically permanently mounted on an axle or attached to a drive wheel using the wheel lug bolts. Winches mounted via lug bolts are usually removable, and it is desirable to remove the winch when its use is not anticipated to present a more aesthetically appealing wheel. However, removing the winch is usually cumbersome. Accordingly, it will be appreciated that it would be highly desirable to have a permanent winch that is aesthetically appealing and does not have to be removed.

Winches mounted using lug bolts sometimes require replacing factory lug bolts with bolts that are longer than the original equipment lug bolts to accommodate the thickness of the winch attachments. These longer bolts complicate the process of removing the winch when its use is not anticipated because the shorter, factory lug bolts have to be installed again. Accordingly, it will be appreciated that it would be highly desirable to have a winch that does not attach using the lug bolts and can be easily readied for use.

SUMMARY OF THE INVENTION

The present invention is directed to overcoming one or more of the problems set forth above. Briefly summarized, according to one aspect of the present invention, a wheel for a vehicle is adapted for use as a winch. The wheel has an axis of rotation, an end face and a contoured surface visible when a tire is mounted on the wheel. A plurality of spaced brackets are fastened to the surface of the wheel and lie parallel to the axis of rotation. A plurality of fingers, with each finger slidably movable in an associated bracket of the plurality of brackets, are deployable from a retracted position at which the fingers lie parallel to the axis of rotation and do not protrude beyond the end face of the wheel, and an extended position at which the fingers extend beyond the end face. When extended, the fingers can engage a rope attached to a stationary object, and when the wheel is rotated, the vehicle can be drawn toward the stationary object thereby rescuing the vehicle from tractionless environments.

When a pulley is pivotally mounted on an aligned non-driving wheel of the vehicle, the rope can be attached to any stationary object regardless of whether the object is aligned with the drive wheel. The aligned pulley prevents the rope from slipping off the fingers. The pulley can be attached to other components of the vehicle as long as it is sufficiently aligned to prevent the rope from slipping off the fingers.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
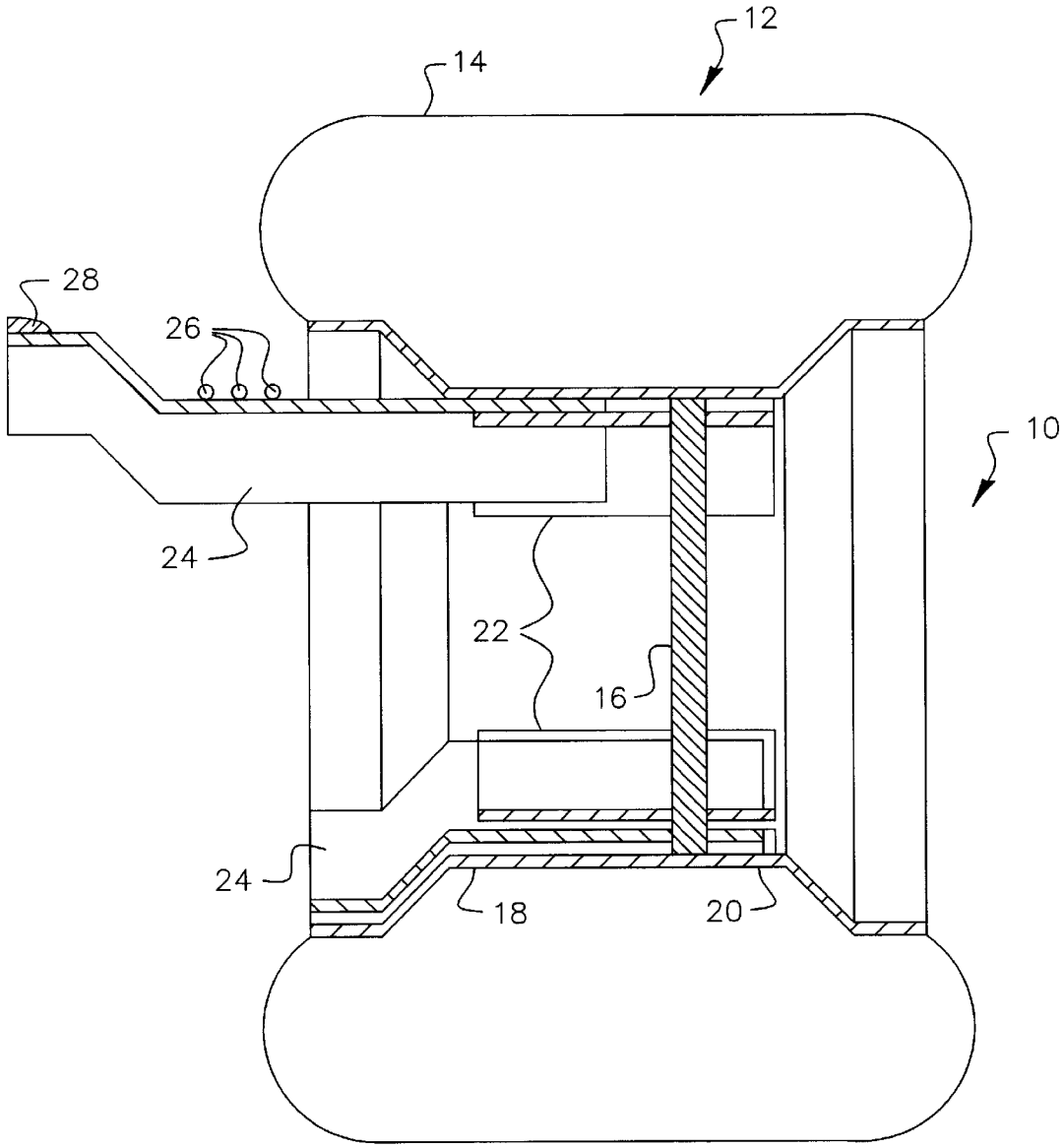
FIG. 1 is a diagrammatic longitudinal sectional view of a preferred embodiment of a vehicle wheel incorporating deployable fingers according to the present invention.
Figure 2:
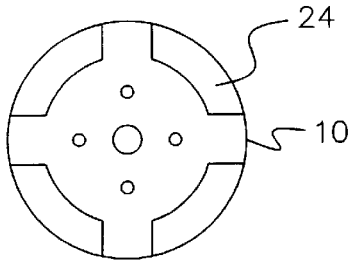
FIG. 2 is a diagrammatic side view of the wheel of FIG. 1.

Referring to FIGS. 1 and 2, a wheel 10 is provided for a vehicle 12, such as an all terrain vehicle for example, to function as a drive wheel adapted for use as a winch. Wheel 10 is has an axis of rotation, an end face, a bead surface and a contoured surface. The contoured surface lies between the end face and axis of rotation while the bead surface lies outboard of the axis of rotation and end face. A tire 14 (FIG. 5) mounted on the wheel seats against the bead surface. Wheel 10 is divided by structural support member 16 into outboard portion 18 and inboard portion 20. The contoured surface of the outboard portion 18 is the portion of the wheel visible when the wheel and tire are mounted on the vehicle A plurality of brackets 22 are fastened to the contoured surface of wheel and lie parallel to the axis of rotation. Brackets 22 are preferably fastened by welding, but can be attached with bolts or integrally formed. Each bracket is preferably a receiving tube that has a circumferential or peripheral portion in contact with the contoured surface and configured to fit flush against the contoured surface. Because the wheel is circular, the peripheral portion in contact with the contoured surface is also arcuate preferably spanning a distance of at least about half an inch. This translates to an arc of at least about six degrees for a nine inch wheel and about four degrees for a fifteen inch wheel. While smaller arcs can be used, doing so detracts from aesthetic appeal making the wheel less desirable. Too large an arc unnecessarily adds bulk and weight to the wheel which is also undesirable. While the wheel will work with only a single bracket, two brackets speed the winch operation, three brackets distribute loads better, and four brackets improve speed, load distribution and look better.

Figure 4:
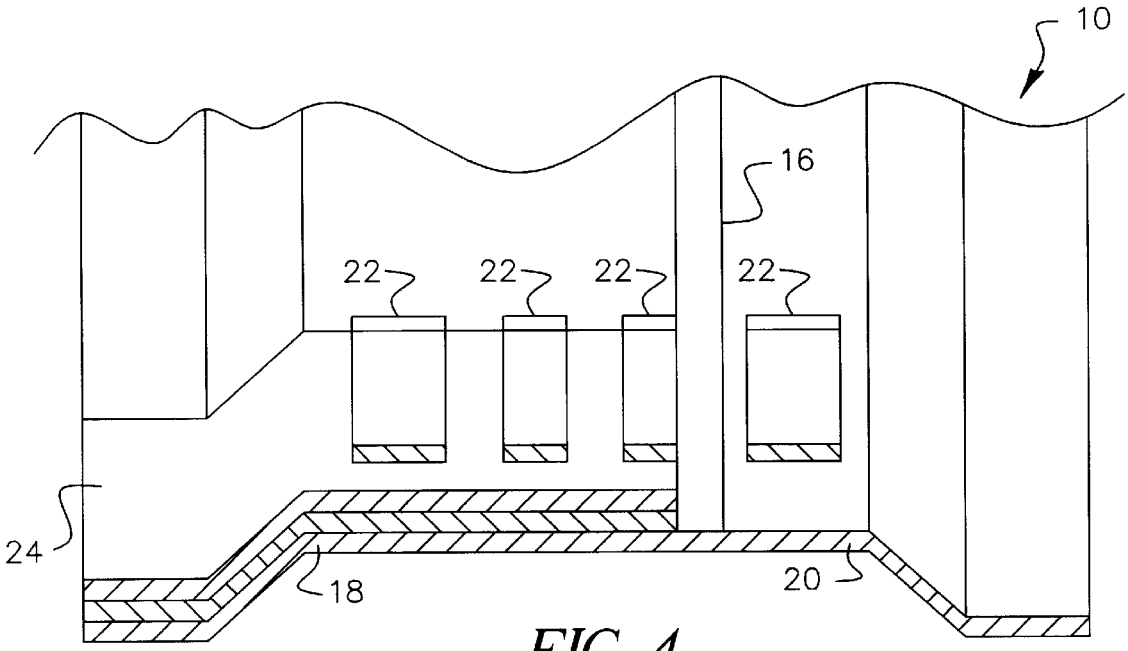
FIG. 4 is a partial sectional view of a wheel similar to FIG. 1 but illustrating another embodiment.

Referring to FIGS. 1 and 4, each bracket may be a solid or one piece bracket 22 (FIG. 1) or may be a segmented bracket 22' (FIG. 4) formed of a number of aligned segments. Solid bracket 22 preferably extends from outboard portion 18 across structural support member 16 to inboard portion 20 through existing openings in structural support member 16 or through openings formed therein for the bracket. Similarly, segmented bracket 22' extends from outboard portion 18 across structural support member 16 to inboard portion 20 through existing openings in structural support member 16 or through openings formed therein for the bracket. Bracket 22' offers the advantages of adding less weight to the wheel and of providing areas for color personalization.

Again referring to FIG. 1, each bracket 22 has an associated finger 24 slidably movable therein. Finger 24 has a contoured distal portion matching the contour of the contoured surface of the wheel. Finger 24 is deployable from a retracted position at which finger 24 lies parallel to said axis of rotation against the arcuate portion of bracket 22 and does not protrude beyond the end face of the wheel. When deployed finger 24 extends beyond the end face a distance sufficient to engage and entwine a rope 26. The finger can have a groove, slot or indentation on its inside end portion to mate with a protrusion or O-ring type device in the bracket to stop the extending motion of the finger or to give a sensory indication of when there is sufficient deployment. The finger could simply be color coded or provide some other sort of visual indicator of deployment.

Figure 3:
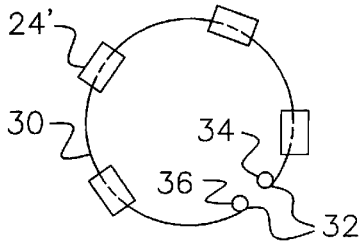
FIG. 3 is a diagram illustrating a locking ring for the wheel of FIG. 1.

Finger 24 preferably has a protrusion 28 on the distal end portion thereof extending from the finger toward the contoured surface of the wheel to tension the finger and lock the finger in position against the wheel when finger 24 is retracted. Protrusion 28 acts as a wedge to lodge the finger against the wheel when the finger is retracted into the bracket. Alternatively, a ring 30 (FIG. 3) may be attached to the distal ends of the fingers 24' to urge the fingers against the contoured surface of the wheel thereby locking the fingers in the retracted position. Ring 30 preferably passes through openings in the fingers, but may be welded to the fingers. Ring 30 preferably has a slit or air gap 32 to allow slight compression for ease of installation. First and second grips 34, 36 are positioned on either side of air gap 32 to facilitate compressing the ring by hand or with a simple pair of pliers. Ring 30 can be conveniently constructed of wire that can be compressed using the fingers thereby eliminating the need for any tools. The wire or the distal end of the fingers preferably engage a groove, depression or channel on the contoured surface for locking engagement.

Figure 5:
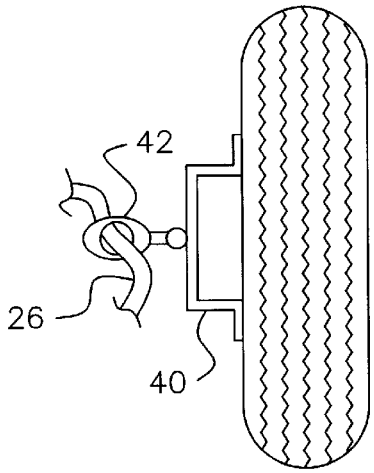
FIG. 5 is a front view of a non-driving wheel of a vehicle incorporating a pulley for use with the wheel winch of FIG. 1.
Figure 6:
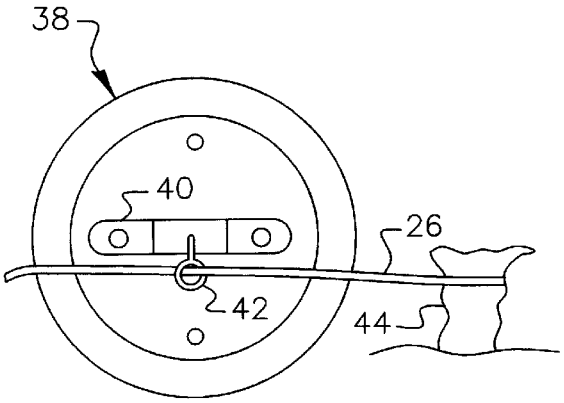
FIG. 6 is a side view of the wheel of FIG. 5.

Referring now to FIGS. 1, 5 and 6, wheel 10 is a drive wheel; that is, it is a wheel to which torque is delivered through the lug bolts for propelling the vehicle. On the other hand, wheel 38, mounted on the same side of the vehicle as drive wheel 10, is not a drive wheel. Wheel 38 has a bracket 40 attached thereto using the lug bolts or using other bolts extending into or through a portion of the wheel. A pulley 42 is pivotally mounted on bracket 40 to receive rope 26. Rope 26 has one end fastened to the fingers on drive wheel 10 and has the other end fastened to a tree 44 or other stationary object. By passing rope 26 through pulley 42, alignment of rope 26 on the fingers is ensured. Although winch action is obtained without pulley 42, the pulley aids in uniform winding of the rope on the fingers and prevents the rope from slipping off the fingers.

If a tree is not available, then almost any fixed object can be used to terminate the rope. Also, the pulley can be mounted at other locations on the vehicle so long as there is alignment with the fingers to prevent the rope from slipping. The pulley can be at a higher elevation the fingers to provide an amount of lift to help free the vehicle.

Operation of the wheel is believed to be apparent from the foregoing description and drawings, but a few words will be added for emphasis. When deployed (see upper portion of FIG. 1) from a retracted position (see bottom portion of FIG. 1), the fingers extend beyond the end face of the wheel a predetermined distance to receive the rope. The rope is attached to one finger and entwined about the others. The rope is threaded through the alignment pulley and tied to a fixed object. When power is applied, the wheel rotates, clockwise for forward motion and counterclockwise for rearward motion, winding the rope thereon making the rope taut. Continued rotation causes the vehicle to move thereby freeing the vehicle. Once the vehicle is free, the rope is removed from the fingers. The fingers are then pushed into the wheel to the retracted position. The ring or finger protrusion locks the finger in the retracted position. The wheel thus functions as a winch without having to bother with unsightly hubs or other attachments, and is always available for winch action by simply pulling out the fingers.

It can now be appreciated that a wheel for a vehicle adapted for use as a winch has been presented. A combination of brackets and deployable fingers contained within the brackets provide an attaching means for a rope to be tied to a fixed object to extract the vehicle from a stuck or bogged down condition. The brackets and fingers are aesthetically pleasing, permanent parts of the wheel that are not connected to the lug bolts that hold the wheel on the vehicle. It is easily readied for use by pulling the fingers to the deployed position.

While the invention has been described with reference to the all terrain vehicles, it is apparent that the invention is easily adapted to other vehicles and machines that can become stuck or bogged down during use. While the invention has been described with particular reference to the preferred embodiments, it will be understood by those skilled in the art that various changes may be made and equivalents may be substituted for elements of the preferred embodiment without departing from invention. For example, the brackets do not have to encircle or enclose the fingers, grooves in the fingers could ride on lands of the brackets or vice-versa. In addition, many modifications may be made to adapt a particular situation and material to a teaching of the invention without departing from the essential teachings of the present invention. For example, an upturned lip on the distal end of the finger could be used for rope retention thereby reducing the need for the alignment pulley.

As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. A wheel for a vehicle adapted for use as a winch, said wheel having an axis of rotation, an end face and a surface with a contour, said wheel comprising:

a plurality of brackets fastened to a surface of said rim, said brackets lying parallel to the axis of rotation; and a plurality of fingers with each finger slidably movable in an associated bracket of said plurality of brackets and deployable from a retracted position at which said finger lies parallel to said axis of rotation and does not protrude beyond the end face of said wheel, and an extended position at which said finger extends beyond said end face.

2. A wheel, as set forth in claim 1, wherein each of said fingers has a contour matching the contour of said wheel at a point of contact with said surface of said wheel.

3. A wheel, as set forth in claim 1, wherein each of said fingers has a protrusion on an end portion thereof extending from said finger toward said wheel to tension said finger and lock said finger in position against said wheel.

4. A wheel, as set forth in claim 1, including a ring attached to an end portion of each of said fingers to urge said fingers outward toward said rim to thereby lock said fingers in position against said wheel.

5. A wheel, as set forth in claim 4, wherein said ring has a slit therein.

6. A wheel, as set forth in claim 5, including first and second grips positioned on either side of said slit to facilitate changing the width of said slit for extending and retracting said fingers.

7. A wheel, as set forth in claim 1, wherein each of said brackets is non-continuous having aligned segments for receiving an associated finger.

* * * * *